US006653599B2

(12) United States Patent
Nam

(10) Patent No.: US 6,653,599 B2
(45) Date of Patent: Nov. 25, 2003

(54) HAIR STYLER WITH DETACHABLE HEATING BARS

(76) Inventor: Cho Ok Nam, 791-1987, MeeAa 1-dong, Kangbuk-gu, Seoul (KR)

( * ) Notice: Subject to any disclaimer, the term of this patent is extended or adjusted under 35 U.S.C. 154(b) by 0 days.

(21) Appl. No.: 10/165,846

(22) Filed: Jun. 6, 2002

(65) Prior Publication Data

US 2002/0190047 A1 Dec. 19, 2002

(51) Int. Cl.[7] ..... A45D 1/04
(52) U.S. Cl. ..... 219/222; 219/225; 132/224
(58) Field of Search ..... 219/222, 221, 219/223, 224, 225, 227, 228, 229, 230, 536, 542; 132/269

(56) References Cited

U.S. PATENT DOCUMENTS 2,243,061 A * 5/1941 Lamia ..... 38/71
3,927,684 A * 12/1975 Lam ..... 132/119.1
4,739,151 A * 4/1988 Smal ..... 219/225
5,064,993 A * 11/1991 Hashimoto ..... 219/223
5,783,800 A * 7/1998 Thompson et al. ..... 219/225
5,861,607 A * 1/1999 Jarrett ..... 219/225
5,934,293 A * 8/1999 Kaizuka ..... 132/225
5,941,253 A * 8/1999 Kaizuka ..... 132/232
6,043,457 A * 3/2000 Hashimoto ..... 219/223
6,173,718 B1 * 1/2001 Okumoto et al. ..... 132/224
6,223,753 B1 * 5/2001 Lo ..... 132/224
6,307,181 B1 * 10/2001 Hashimoto ..... 219/223
6,386,206 B2 * 5/2002 Lee ..... 132/225

* cited by examiner

*Primary Examiner*—Sang Y. Paik
*Assistant Examiner*—Vinod D. Patel
(74) *Attorney, Agent, or Firm*—Hovey Williams LLP

(57) ABSTRACT

A hair styler includes detachable heating bars which allows a user to easily change a set of existing heating bars with another set of such bars and easily fasten the newly attached heating bars to the arms of the styler without separate fasteners. Two heating bars are provided, each including an insulator assembled through a slide type engagement. The insulators have has both a hook and a locking flange at each end thereof. One arm detachably seats the first heating bar therein, and includes an electrical circuit, a power switch, and a temperature controller, along with a locking recess for removably receiving the hook of one of the insulators. A second arm seats the second heating bar therein, and a jointing unit connects the first and second arms to form a tongs shape. Power is supplied to the styler by an electric cord.

1 Claim, 5 Drawing Sheets

HAIR STYLER WITH DETACHABLE HEATING BARS

BACKGROUND OF THE INVENTION

1. Field of the Invention

The present invention relates, in general, to hair stylers with detachable heating bars and, more particularly, to a hair styler designed to allow a user to easily change a set of existing heating bars with another set of bars and easily fasten the newly attached heating bars to the arms of the styler without using a separate fastening means.

2. Description of the Prior Art

In a conventional hair styler that is an electric appliance for setting or styling the hair, two detachable heating bars 2 are screwed to the two arms 1 of the styler using a plurality of setscrews tightened into the screw holes 3 formed at the two arms 1, as shown in FIG. 1. An electric circuit is set in one of the two arms 1 for heating the two heating bars 2 using electric power supplied from an external power source through a cord 4. The two arms 1 are hinged to each other at their ends by a joint 5 to form a tongs shape.

Such a hair styler typically has several sets of heating bars, which have different shapes at their styling surfaces for allowing a user to create different hair styles as desired. When it is desired to create a new hair style, the user changes a set of existing heating bars with another set of bars prior to styling his or her hair.

However, when it is desired to change a set of existing heating bars with another set of bars, the conventional hair styler forces a user to loosen the setscrews from the two arms of the styler, remove the existing bars from the arms, seat the new bars in the empty arms, and fasten the new bars to the arms by tightening the setscrews. Such conventional hair stylers are thus inconvenient to users.

In addition, the heating bars are directly attached to the arms of the conventional hair stylers without using any insulator interposed between the arms and the bars, and so the heating bars undesirably heat the arms during a hair styling work. Users of the stylers are thus forced to be careful of the hot arms while setting or styling the hair.

SUMMARY OF THE INVENTION

Accordingly, the present invention has been made keeping in mind the above problems occurring in the prior art, and an object of the present invention is to provide a hair styler, which has several sets of detachable heating bars and is designed to allow a user to easily change a set of existing heating bars with another set of bars and easily fasten the newly attached heating bars to the arms without using a separate fastening means.

Another object of the present invention is to provide a hair styler, which has insulators interposed between the arms and the heating bars, thus reducing danger of burning to users caused by excessively heated arms while setting or styling the hair.

In order to accomplish the above objects, the present invention provides a hair styler, comprising: two heating bars each assembled with an insulator through a slide type engagement, the insulator having both a hook and a locking flange at each end thereof; a first arm detachably seating a first one of the two heating bars therein, the first arm including: an electric circuit applying electric power from an external power source to the two heating bars; a power switch for turning on or off the electric circuit; a temperature controller for controlling a temperature of heat dissipated from the two heating bars; a first locking recess for removably receiving the hook of the first heating bar therein; a support protrusion for thermally insulating the first arm from the first heating bar and supporting the first heating bar in the first arm; and a cover for covering the electric circuit to conceal the circuit from the outside of the hair styler; a second arm having a second locking recess for removably receiving the hook of the second heating bar in the second locking recess; a jointing unit provided at ends of the first and second arms for jointing the arms together to form a tongs shape; and an electric cord connected to the hair styler for applying electric power from the external power source to the electric circuit.

BRIEF DESCRIPTION OF THE DRAWINGS

The above and other objects, features and other advantages of the present invention will be more clearly understood from the following detailed description taken in conjunction with the accompanying drawings, in which.

DETAILED DESCRIPTION OF THE INVENTION

Figure 1:
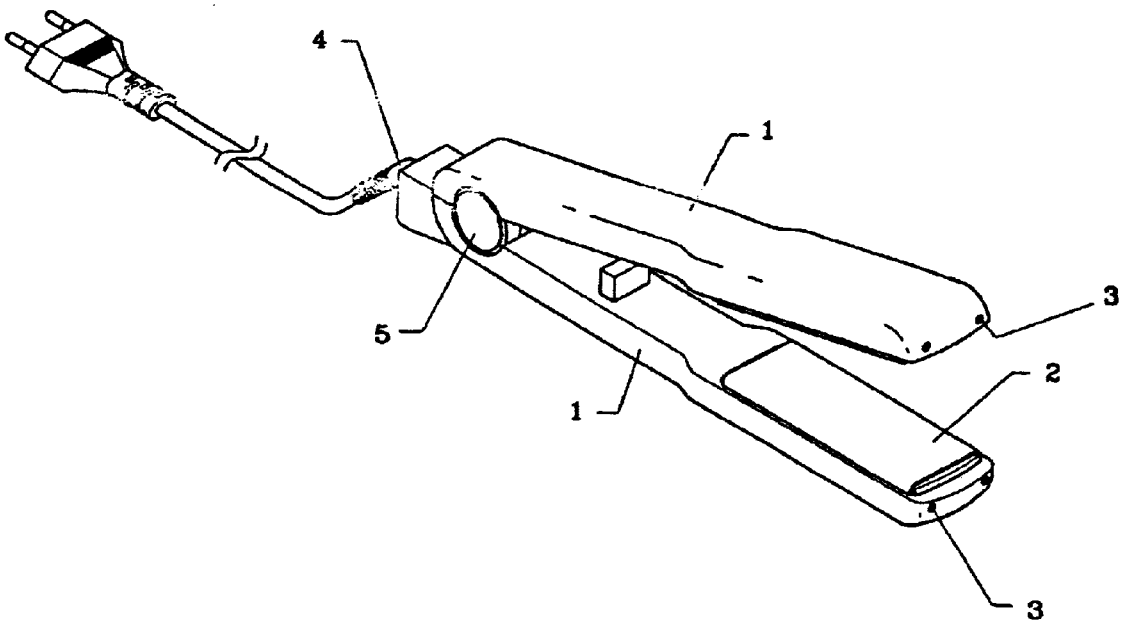
FIG.1 PRIOR ART
FIG. 1 is a perspective view of a conventional hair styler.

Reference should now be made to the drawings, in which the same reference numerals are used throughout the different drawings to designate the same or similar components.

Figure 2:
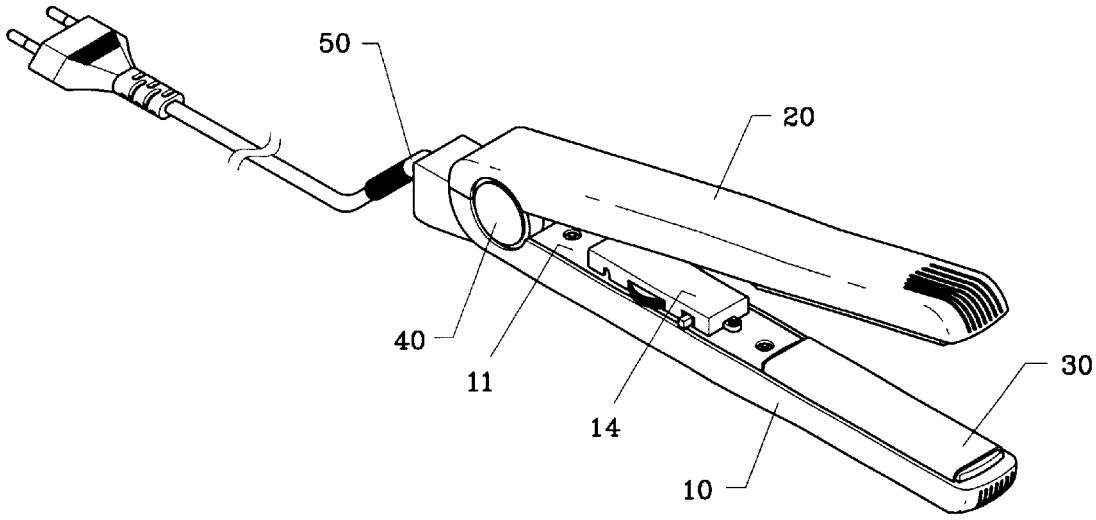
FIG. 2 is a perspective view of a hair styler in accordance with the preferred embodiment of the present invention.
Figure 3:
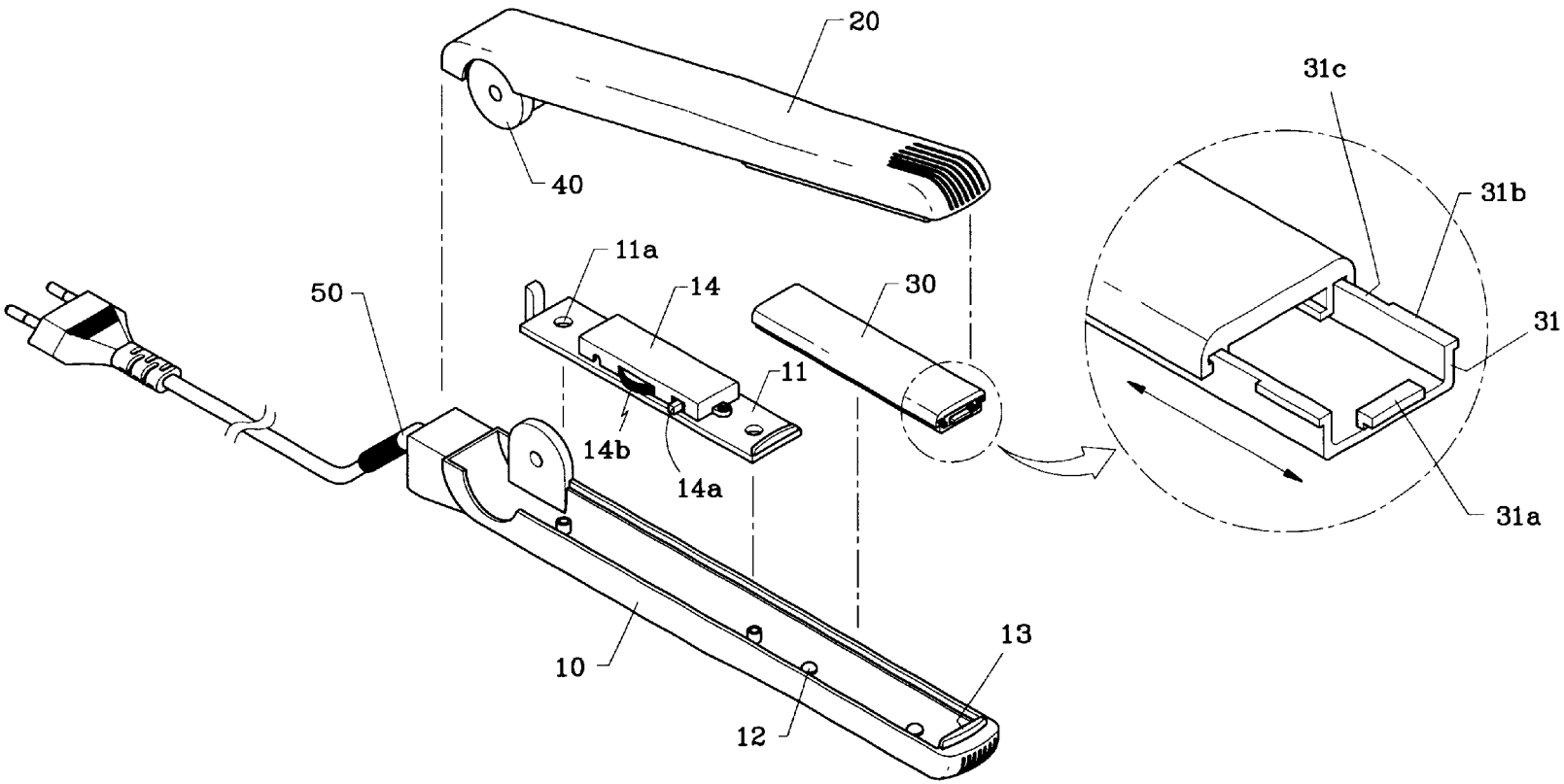
FIG. 3 is an exploded perspective view of the hair styler of FIG. 2.

FIGS. 2 and 3 are views of a hair styler in accordance with the preferred embodiment of this invention. As shown in the drawings, the hair styler of this invention has two jointed arms, that is, first and second arms 10 and 20. First and second heating bars 30 are easily, simply and detachably attached to the two arms 10 and 20, and dissipate heat to the hair during hair styling when the two bars 30 are electrically activated by electric power applied from an external power source through an electric circuit (not shown) which is set in the first arm 10. Each heating bar 30 also has an insulator 31, which insulates the heating bar 30 to prevent heat transfer from the bar 30 to an associated arm 10 or 20. The heating bar 30 has a hook 31*a* and two locking flanges 31*b* at each end of the insulator 31 such that the heating bar 30 is easily, simply and detachably assembled with an associated arm 10 or 20.

The first arm 10, which is detachably seated in one heating bar 30, has a plurality of first support protrusions 12 and a first locking recess 13. The support protrusions 12 support the heating bar 30 in the first arm 10 to prevent an undesired movement of the bar 30 in the first arm 10. The support protrusions 12 also have a thermal insulating function in that they separate the heating bar 30 from the arm 10, and reduce thermal damage to the arm 10 caused by the heating bar 30. The first locking recess 13 removably receives the hook 31*a* of the heating bar 30 therein such that the heating bar 30 is closely and detachably seated in the first arm 10. The first arm 10 also has a control unit, which is screwed to the arm 10 and fabricated with two covers 11 and 14. The control unit has the electric circuit (not shown), which controllably applies electric power from an external power source to the two heating bars 30 of the first and second arms 10 and 20, thus allowing the two heating bars 30 to dissipate heat to the hair during a hair styling work. The control unit also has a power switch 14*a,* by which a user turns on or off the hair styler. The control unit further includes a temperature controller 14*b,* by which the user controls the temperature of heat dissipated from the two heating bars 30. The two covers 11 and 14 of the control unit cover the electric circuit to conceal the circuit from the outside of the hair styler.

The second arm 20 is jointed to the first arm 10 at their ends to form a desired tongs shape, and has a plurality of second support protrusions 12 and a second locking recess 13 which have the same functions as those of the first arm 10.

In order to joint the two arms 10 and 20 to each other at their ends to form a desired tongs shape, a jointing unit 40 is provided at the ends of the two arms 10 and 20.

An electric cord 50, having a plug, is connected to the hair styler, and applies electric power from the external power source to the control unit.

The two arms 10 and 20 are jointed to each other at the jointing unit 40, thus forming a desired hair styler having a tongs shape, in which the two heating bars 30 of the two arms 10 and 20 thermally set or style the hair while gripping the hair when the two arms 10 and 20 are closed by a user.

In the present invention, it is preferred to joint the two arms 10 and 20 at the jointing unit 40 using a hinging means.

Figure 4A:
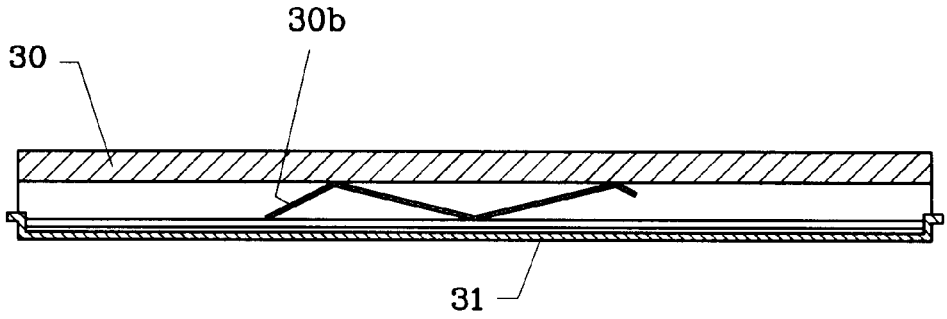
FIG. 4*a* is a sectional view of a heating bar included in the hair styler of this invention.
Figure 4B:
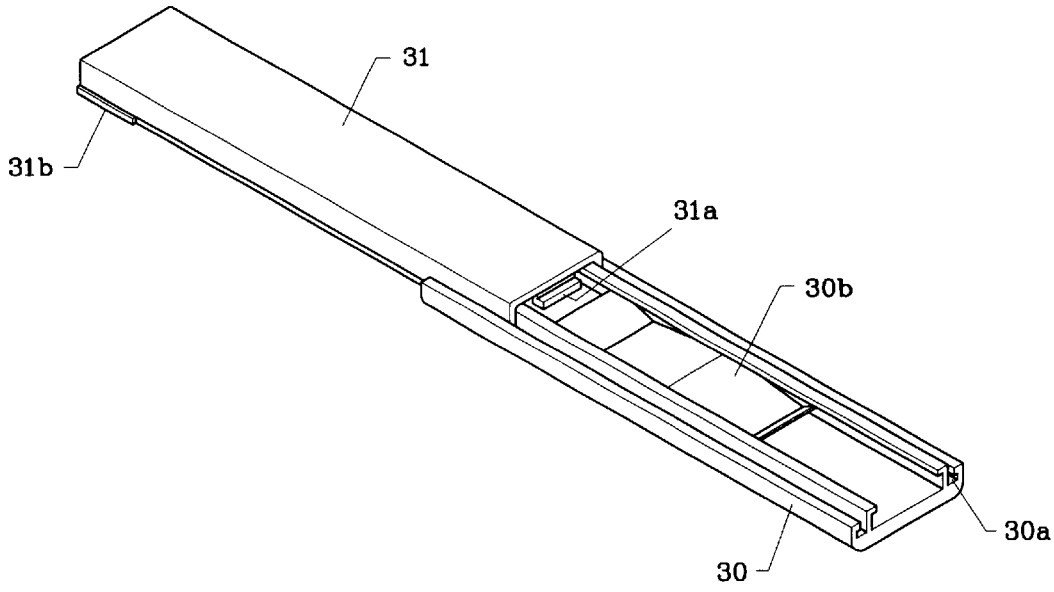
FIG. 4*b* is a perspective view, showing the structure for assembling an insulator with the heating bar of this invention.

FIGS. 4*a* and 4*b* are view, showing the structure for assembling the insulator with the heating bar of this invention. In order to detachably assemble the insulator 31 with the heating bar 30 of this invention, a locking groove 30*a* is formed along each longitudinal edge of the heating bar 30. A locking rail 31*c* is formed along each longitudinal edge of the insulator 31, and removably engages with the locking groove 30*a* of the heating bar 30.

In such a case, the engagement of the bar 30 with the insulator 31 is preferably accomplished by a slidable engagement. A supporter 30*b* is set on the inner surface of the heating bar 30. This supporter 30*b* prevents the insulator 31 from excessively passing over the heating bar 30 when assembling the insulator 31 with the heating bar 30, and supports the insulator 31 on the heating bar 30.

Due to the two locking flanges 31*b* formed at each end of the insulator 31, the insulator 31 is less likely to be undesirably removed from the heating bar 30.

As shown in FIGS. 2 and 3, the lower cover 11 of the control unit has a plurality of screw holes 11*a,* at which the control unit is fastened to the first arm 10 using a plurality of setscrews. A plurality of internally-threaded bosses are formed at the first arm 10 for fastening the control unit to the first arm 10 using the setscrews. In addition, a circuit holder (not shown) is provided in the first arm 10 for holding the electric circuit in the arm 10.

The electric circuit is set in the first arm 10, and controllably applies electric power to the two heating bars 30 of the first and second arms 10 and 20. Such an electric circuit is not set in the second arm 20, but is only set in the first arm 10.

The operational effect of the hair styler having such detachable heating bars of this invention will be described herein below.

In order to assemble the insulator 31 with the heating bar 30, the insulator 31 slides on the heating bar 30 from an end of the bar 30 after initially engaging the two locking rails 31*c* of the insulator 31 with the two locking grooves 30*a* of the heating bar 30. When the insulator 31 is completely assembled with the heating bar 30, the insulator 31 is less likely to be undesirably removed from the heating bar 30 due to both the locking flanges 31*b* of the insulator 31 and the supporter 30*b* of the heating bar 30.

After two heating bars 30 are assembled with two insulators 31, respectively, the two heating bars 30 are respectively attached to the two arms 10 and 20 by engaging the hooks 31*a* of the insulators 31 of the heating bars 30 with the locking recesses 13 of the arms 10 and 20. In such a case, the insulator 31 of each heating bar 30 comes into close contact with the support protrusions 12 of an associated arm 10 or 20, and so the heating bar 30 is stably held in the arm so as to be prevented from an undesired movement within the arm.

In order to use the hair styler, a user connects the cord 50 to an external power source prior to turning on the power switch 14*a* of the control unit set in the first arm 10.

Thereafter, the user sets a desired temperature of heat dissipated from the heating bars 30 by manipulating the temperature controller 14*b*. The circuit thus transmits electric power to the two heating bars 30 of the two arms 10 and 20 such that the two bars 30 dissipate heat of the adjusted temperature.

The user positions the two arms 10 and 20 of the hair styler around the hair, and closes the arms 10 and 20 by compressing them such that the two arms rotate around the jointing unit 40, with the two heating bars 30 of the arms 10 and 20 gripping the hair. The two heating bars 30 thus thermally set or style the hair to create a desired hair style.

As described above, the present invention provides a hair styler with detachable heating bars. This hair styler is designed to allow a user to easily change a set of existing heating bars with another set of bars and easily fasten the newly attached heating bars to the arms of the styler without using a separate fastening means. This hair styler is thus convenient to users.

In this hair styler, an insulator is assembled with each heating bar such that the insulator is interposed between the heating bar and an associated arm, thus reducing danger of burning to users caused by excessively heated arms while setting or styling the hair.

Although a preferred embodiment of the present invention has been described for illustrative purposes, those skilled in the art will appreciate that various modifications, additions and substitutions are possible, without departing from the scope and spirit of the invention as disclosed in the accompanying claims.

What is claimed is:

1. A hair styler, comprising:

two heating bars each assembled with an insulator through a slide type engagement, said insulator having both a hook and a locking flange at each end thereof;

a first arm detachably seating a first one of the two heating bars therein, said first arm including:

an electric circuit applying electric power from an external power source to the two heating bars;

a power switch for turning on or off the electric circuit;

a temperature controller for controlling a temperature of heat dissipated from the two heating bars;

a first locking recess for removably receiving the hook of the first heating bar therein;

a support protrusion for thermally insulating the first arm from the first heating bar and supporting the first heating bar in the first arm; and a cover for covering the electric circuit to conceal the circuit from the outside of said hair styler;

a second arm having a second locking recess for removably receiving the hook of the second heating bar in the second locking recess;

a jointing unit provided at ends of the first and second arms for jointing said arms together to form a tongs shape; and an electric cord connected to the hair styler for applying electric power from the external power source to the electric circuit.

* * * * *